United States Patent [19]

Bianca

[11] Patent Number: 4,822,286

[45] Date of Patent: Apr. 18, 1989

[54] HOOD HAVING AN INTEGRAL STRAIN RELIEF FOR USE WITH ELECTRICAL CONNECTORS

[75] Inventor: Giuseppe Bianca, Stouffville, Canada

[73] Assignee: AMP Incorporated, Harrisburg, Pa.

[21] Appl. No.: 193,010

[22] Filed: May 12, 1988

[51] Int. Cl.[4] ..... H01R 13/58; H01R 13/658

[52] U.S. Cl. ..... 439/610; 439/460

[58] Field of Search ..... 439/460, 465, 466–468, 439/607–610

[56] References Cited

U.S. PATENT DOCUMENTS 3,781,766 12/1973 Teagno et al. .
3,986,765 10/1976 Shaffer et al. .
4,549,780 10/1985 Bertini et al. .
4,629,276 12/1986 Genaro et al. .
4,659,166 4/1987 Morningstar et al. .

FOREIGN PATENT DOCUMENTS 2829639 11/1979 Fed. Rep. of Germany ..... 439/460
1396790 6/1975 United Kingdom ..... 439/460

*Primary Examiner*—Eugene F. Desmond
*Attorney, Agent, or Firm*—Allan B. Osborne

[57] ABSTRACT

A hood for protecting an electrical connector and having a wire strain relief member integral therewith. More particularly, the hood is formed from a pair of mateable components. The strain relief member is formed simultaneously by half shells, projecting in to the cavity of the hood from the end walls, being brought together.

2 Claims, 3 Drawing Sheets

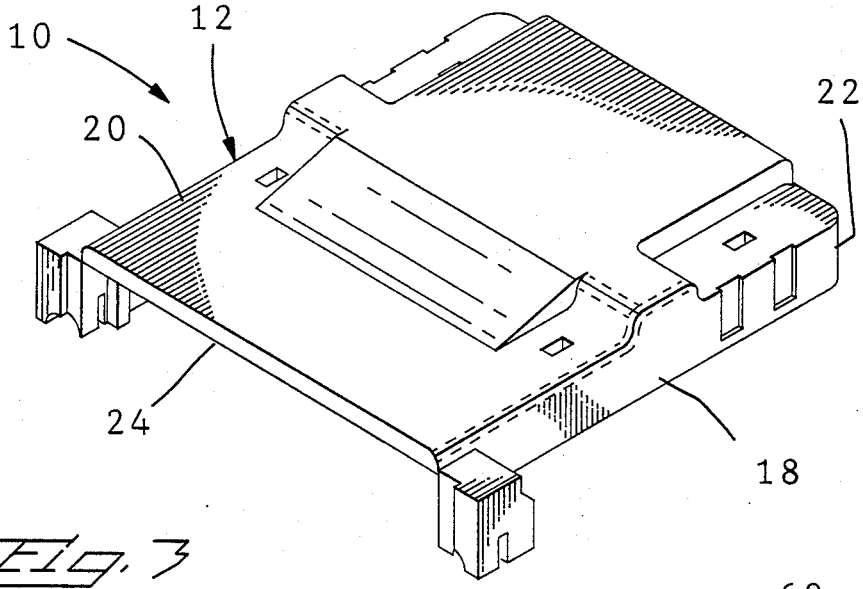
Fig. 3
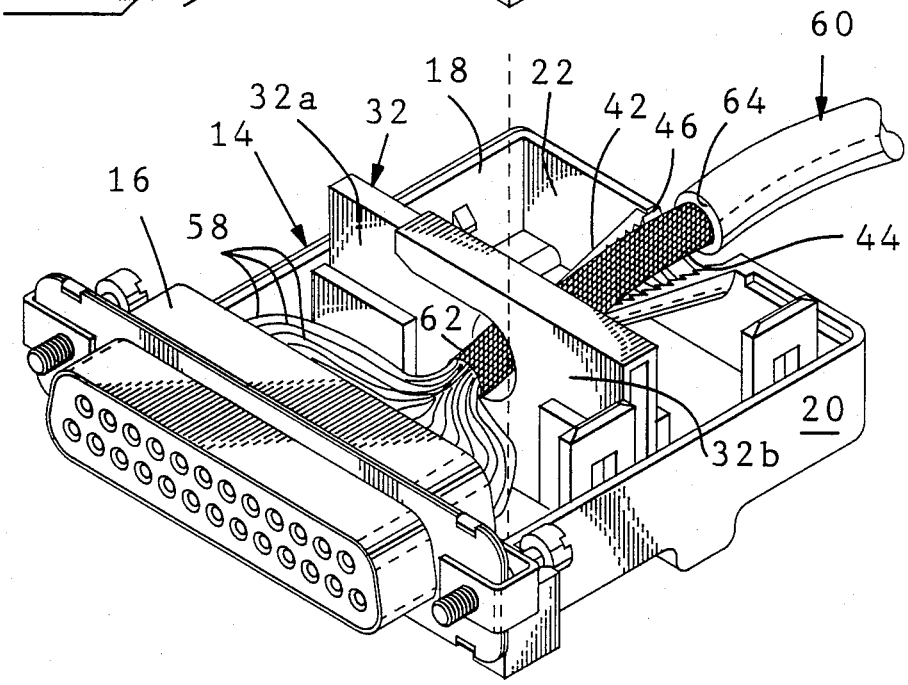

HOOD HAVING AN INTEGRAL STRAIN RELIEF FOR USE WITH ELECTRICAL CONNECTORS

FIELD OF THE INVENTION

The invention disclosed herein pertains to hoods in which an electrical connector is positioned and from which a plurality of wires extend and more particularly to hoods having a strain relief to clamp the wires against inadvertent pull-out.

BACKGROUND OF THE INVENTION

With the advent of the electronics industry, a variety of electronic plug connectors have been developed to provide an interface or interconnection between signal carrying wires, usually encased in a sheath or jacket and an electronic device; e.g., a personal computer. As the interconnection is usually easily accessible such as on the back face of the computer, the connector must be protected to prevent the user from experiencing electrical shock. Further, to maintain signal integrity, the connectors must be provided with RFI and EMI shielding. Additionally, the wires terminated to the connector are subject to inadvertent tensional forces and accordingly, a strain relief should be provided.

Solutions to the above problems include providing a shell or hood, made from a dielectric material, in which the connector is positioned such that the mating face thereof projects from the hood or is accessible through an opening in the hood. U.S. Pat. Nos. 3,781,766 and 4,629,276 disclose such hoods.

As is well known, RFI and EMI shielding is provided for by filling the dielectric material with metal particles.

It is also well known to provide housings with a strain relief member clamping the wires to resist rearwardly directed tensional forces. For example, U.S. Pat. No. 4,549,780 discloses a housing having a pair of spaced openings, located at an angle to each other, and an assembly which includes a plug member and a cable clamp. The plug member, with an actuating screw positioed at an angle, is received in and blocks one opening, and the cable clamp, driven by the screw, is received in the other opening for clamping the wires or cable passing therethrough. The plug member and cable clamp are slidingly attached to each other by means of elongated arms on one being received in grooves on the other. Other patents; e.g., U.S. Pat. Nos. 4,629,276 and 3,781,766, also disclose strain relief members which are separate components from the housing or hood and which require a separate assembly step.

It is now proposed to provide a hood having an inwardly directed strain relief member which is an integral part thereof and which clamps the wire bundle or cable without other components or without requiring a separate assembly step.

SUMMARY OF THE INVENTION

According to the invention a protective hood for use with an electrical connector having wires extending therefrom is disclosed. The hood, composed of two halves, includes an inwardly directed strain relief member formed from cantilever shells attached to respective end walls. The wires are placed under compression by the strain relief member being expanded radially outwardly by the wires passing therethrough.

BRIEF DESCRIPTION OF THE DRAWINGS

FIG. 3 is an exploded, perspective view of the hood of FIG. 1 with a terminated connector positioned in one half of the hood and the wires extending outwardly therefrom through the integral strain relief member.

DESCRIPTION OF THE INVENTION

Figure 1:
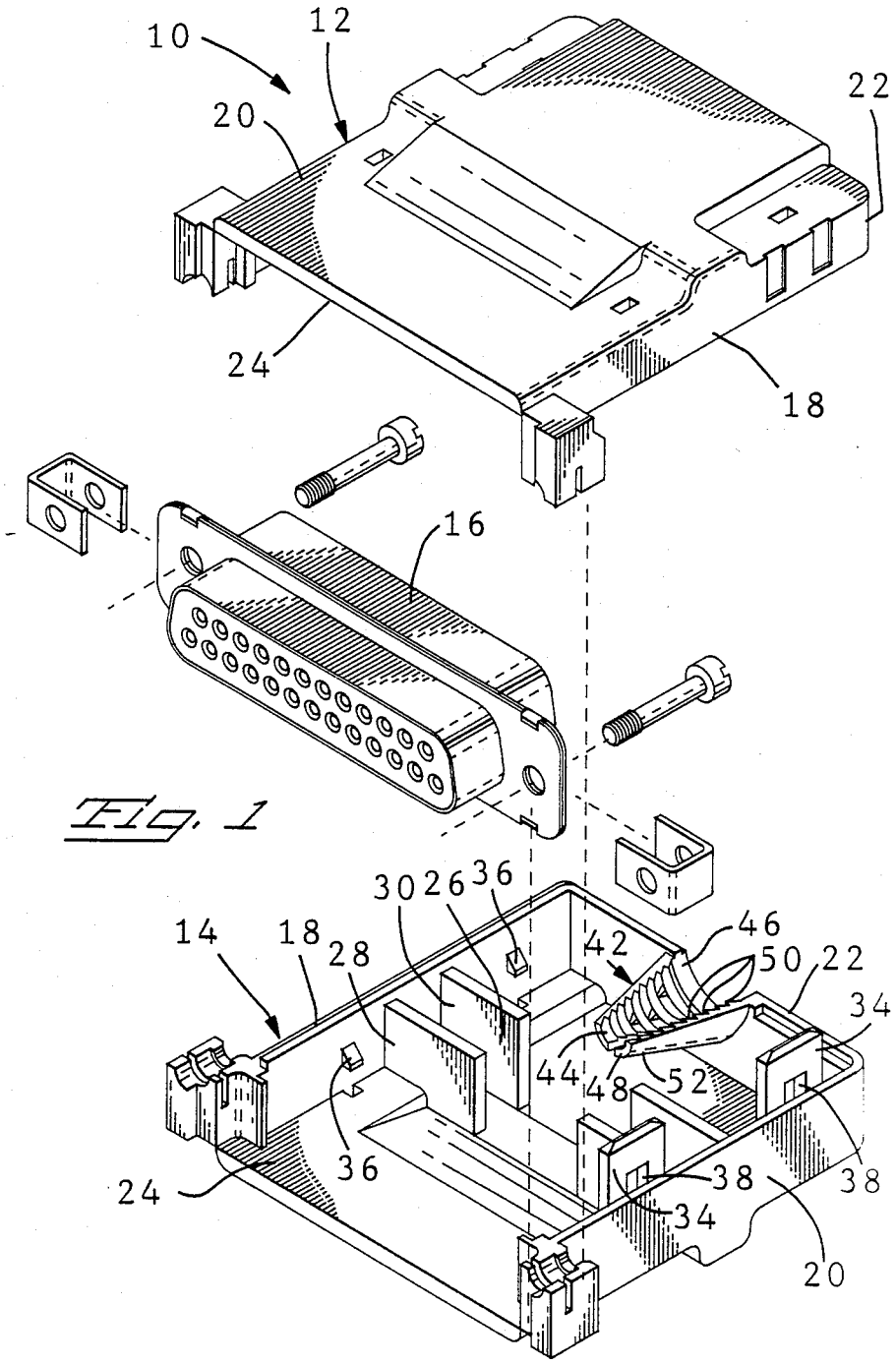
FIG. 1 is an exploded, perspective view of the hood constructed in accordance with the preferred embodiment of the present invention.
Figure 2:
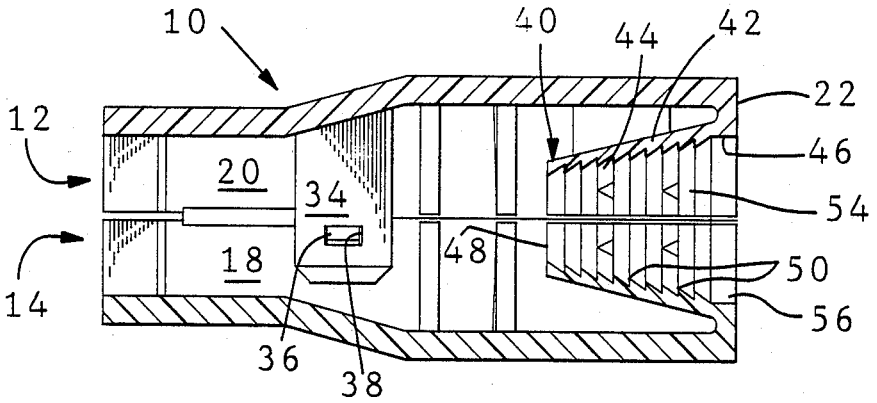
FIG. 2 is a sectioned side view of the hood.
Figure 4:
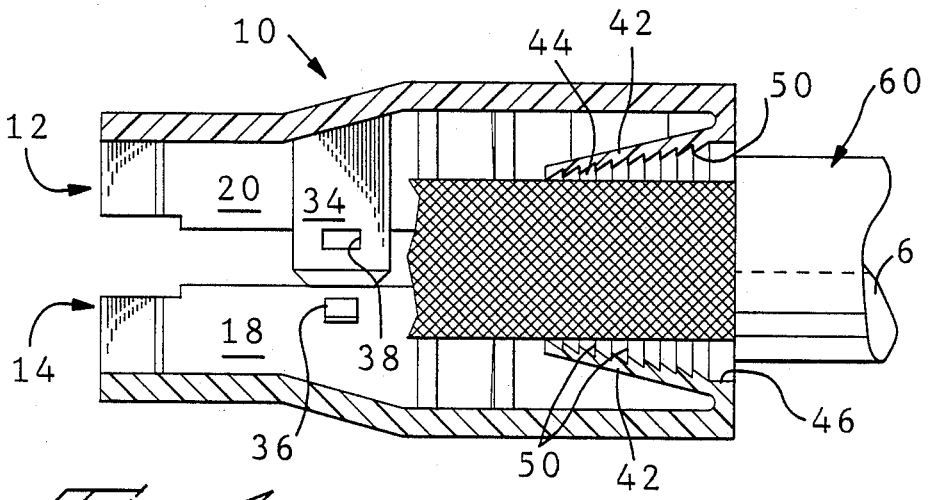
FIGS. 4 and 5 are sectioned side views illustrating the strain relief member.
Figure 5:
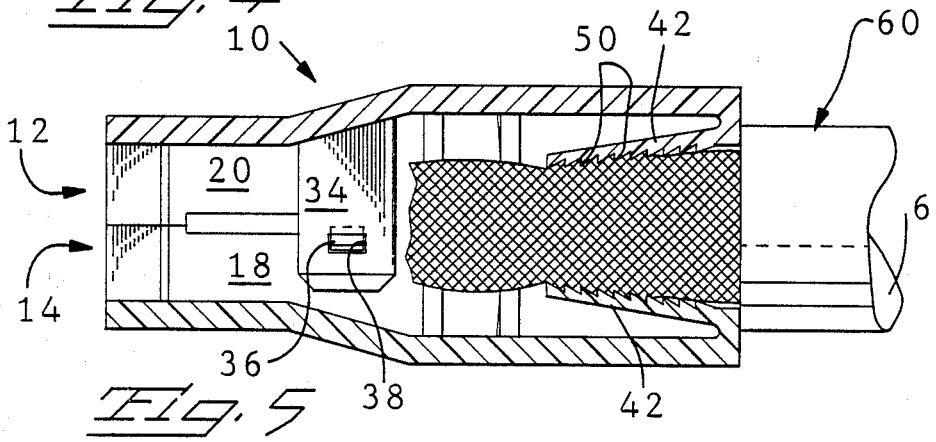

Housing or hood 10 of the present invention, as shown in FIG. 1, includes two halves, 12 and 14, which are mirror images of each other and which when joined, form hood 10 to provide a protective covering for connector 16 contained therein. Each half 12, 14 includes parallel side walls 18, 20 and end wall 22 joining the two side walls 18, 20 at the rear thereof. Front end 24 is opened through which connector 16 extends as shown in FIG. 2. Latch members 34 are spaced slightly inwardly from and extend above side walls 20. Cooperating shoulders 36 are provided on the inside surfaces of side wall 18. As is well known, latch members 34 are provided with openings 38 through which shoulders 36 protrude to hold halves 12,14 together as shown in FIG. 4.

As noted above, halves 12,14 are joined together to form hood 10. Also formed simultaneously is a tapered-shaped strain relief member 40 (FIG. 2) which is comprised of two half shells 42. Each shell 42 resembles a longitudinally bisected and truncated cone so that groove 44 therein narrows from its junction with arcuate groove 46 in end wall 22 to free end 48. The several rows of teeth 50 in groove 44 are slanted towards free end 48. FIGS. 2–5 show this structure more clearly. Wall 52 of shells 42 is thick enough to be self-supporting, yet thin enough to flex somewhat as will be discussed below.

Hood halves 12,14 are preferably molded with the material being polypropylene. To provide for RFI and EMI shielding, suitable metallic particles are added.

FIG. 2 shows the two halves 12,14 joined together to form hood 10 and strain relief member 40. Grooves 44 cooperate to form passage 54 and grooves 46 in end walls 22 form opening 56.

FIG. 3 shows connector 16 positioned in the front portion of hood half 14. Insulated wires 58 of cable 60, which are terminated to contact elements (not shown) within connector 16, are encased in metallic jacket 62 for RFI and EMI shielding. Insulation jacket 64 which surrounds jacket 62 is removed back to where cable 60 enters half 14 through groove 46 so that jacket 62 lays in groove 44 of shell 42.

FIG. 4 shows hood halves 12,14 being joined with the two shells 42 closing around metallic jacket 62. In FIG. 4, the two halves 12,14 are latched togther and half shells 42 cooperate to form tapered strain relief member 40. As the diameter of cable 60 is greater than passage 54 of strain relief member 40, walls 52 flex outwardly, placing cable 60 in compression. Teeth 5 accordingly dig into jacket 62 and because of their slanting disposition, offer a resistance to a force tending to pull cable 60 out of connector 16. In addition to providing a strain relief, strain relief 40 encircles and engages jacket 62 and thus seals off the interior of hood 10. This is an important advantage when RFI and EMI shielding is required.

As can be discerned, a hood having an inwardly directed, integral strain relief member has been disclosed. The strain relief member formed from cooperating half shells in each half of the hood is cone shaped or tapered with slanting teeth provided on the surface of the passage therethrough. The walls of the strain relief member have flexibility so that a cable passing therethrough expands the member and is placed under compression. Further, the teeth bite into the cable to provide a resistance against rearwardly directed tensile forces. The strain relief member further encompassingly engages the cable to provide a seal.

I claim:

1. A protective hood for use with an electrical connector of the type having several wires extending away therefrom, said hood comprising:

two mateable halves formed from a suitable plastics material, each having side and end walls with a groove in said end wall and an inwardly projecting cantilever shell attached to said end wall in alignment with said groove, said halves, upon being mated together, provides a cavity for receiving the electrical connector, an opening through said end walls and a tapered strain relief member formed by cooperation of said shells, said strain relief member projecting into said cavity and having a passage in alignment with said opening for receiving and closely encircling wires extending from the electrical connector which may be in said cavity, said strain relief member being capable of accepting a range of wire or cable sizes.

2. The protective hood according to claim 1 wherein metallic particles are added to said plastics material.

* * * * *

UNITED STATES PATENT OFFICE

CERTIFICATE OF CORRECTION

Patent No. 4,822,286 Dated April 18, 1989

Inventor(s) Giuseppe Bianca

It is certified that error appears in the above-identified patent and that said Letters Patent is hereby corrected as shown below:

In column 4, line 1, claim 1, "fromm" should be --from--.

Signed and Sealed this

Fifth Day of June, 1990

*Attest:*

HARRY F. MANBECK, JR.

*Attesting Officer*

*Commissioner of Patents and Trademarks*